United States Patent [19]

Trenkler et al.

[11] Patent Number: 4,885,214

[45] Date of Patent: Dec. 5, 1989

[54] COMPOSITE MATERIAL AND METHODS FOR MAKING

[75] Inventors: George Trenkler, East Providence, R.I.; Richard G. Delagi, Sharon, Mass.

[73] Assignee: Texas Instruments Incorporated, Dallas, Tex.

[21] Appl. No.: 166,300

[22] Filed: Mar. 10, 1988

[51] Int. Cl.[4] ..... C22C 32/00

[52] U.S. Cl. ..... 428/614; 428/570

[58] Field of Search ..... 428/570, 611, 614, 928

[56] References Cited

U.S. PATENT DOCUMENTS

| | | | |
|---|---|---|---|
| 1,125,161 | 1/1915 | Page | 428/611 |
| 1,125,162 | 1/1915 | Page | 428/614 |
| 2,358,326 | 9/1944 | Hensel et al. | 428/570 |
| 2,370,242 | 2/1945 | Hensel et al. | 428/570 |
| 3,097,329 | 7/1963 | Siemens | 357/67 |
| 3,220,107 | 11/1965 | Clark | 228/130 |
| 3,399,332 | 8/1968 | Savolainen | 357/81 |
| 3,406,446 | 10/1968 | Muldovon | 428/614 |
| 3,555,265 | 1/1971 | Feller | 428/570 |
| 3,682,606 | 8/1972 | Anderson | 428/614 |
| 3,826,172 | 7/1974 | Dawson | 428/614 |
| 4,158,719 | 6/1979 | Frantz | 428/567 |
| 4,283,464 | 8/1981 | Hascoe | 428/594 |
| 4,472,672 | 9/1984 | Spinelli et al. | 363/124 |
| 4,569,692 | 2/1986 | Butt | 428/570 |
| 4,680,618 | 7/1987 | Kuroda et al. | 357/74 |

FOREIGN PATENT DOCUMENTS

| | | | |
|---|---|---|---|
| 3601707 | 8/1987 | Fed. Rep. of Germany | 428/611 |
| 0054236 | 3/1982 | Japan | 428/611 |

*Primary Examiner*—L. Dewayne Rutledge
*Assistant Examiner*—David W. Schumaker
*Attorney, Agent, or Firm*—James P. McAndrews; John A. Haug; Melvin Sharp

[57] ABSTRACT

A composite material has portions of a first material such as a metal or ceramic having coatings of a metal material thereon disposed in a metal matrix material and having a diffusion-bonds between the coating and matrix materials securing the portions of the first material at selected locations in the composite material.

8 Claims, 3 Drawing Sheets

COMPOSITE MATERIAL AND METHODS FOR MAKING

BACKGROUND OF THE INVENTION

The field of this invention is that of composite materials and the invention relates more particularly to composite materials having portions of a first material dispersed in a metal matrix for providing the composite material with improved strength, with improved thermal expansion and conductivity, or with other improved properties.

Related subject matter is disclosed in a commonly assigned copending patent application filed of even date herewith entitled A CIRCUIT SYSTEM, COMPOSITE METAL MATERIAL FOR USE THEREIN, AND A METHOD FOR MAKING THE MATERIAL, Ser. No. 166,290.

Composite materials comprising portions of a first material dispersed in a metal matrix of another material have frequently been proposed for providing a material having some of the properties of the matrix material while also providing improvement of the strength or some other property of the matrix material. Frequently it is proposed that the composite materials be made using powder metal materials. Typically however, problems are encountered in obtaining an adequate bond between the matrix material and the various portions of the first material dispersed in the matrix material. This is particularly true where it is desired that the composite material be provided in strip or bar form or the like suitable for subsequent processing into selected shapes. Some of such previously proposed composite materials as shown in U.S. Pat. Nos. 3,097,329, 3,399,332, 4,283,464, 3,204,158 and 4,680,618, for example, are found to be difficult to manufacture, or to require that the composites be prepared in specific shapes, to provide poor attachment of the matrix material to the dispersed elements within the described matrix, or to provide the composites with less than fully desirable combinations of the intended properties.

BRIEF SUMMARY OF THE INVENTION

It is an object of this invention to provide a novel and improved composite material; to provide such a composite material having a plurality of portions of a first material dispersed in a metal matrix; to provide such an improved material in which the dispersed portions in the metal matrix have metal coatings thereon and have selected bonds between the metal coatings and the matrix materials; to provide such a composite material having a multiplicity of discrete elements of a first metal material having metal coatings thereon metallurgically bonded to the discrete elements, the coated discrete elements being dispersed in a metal matrix and having metallurgical bonds between the coatings of the discrete elements and the metal matrix material for securing the discrete elements at selected locations in the composite material; to provide novel and improved methods for making such composite materials; and to provide composite materials of novel and improved properties.

In accordance with this invention, portions of a first material selected for relatively high strength or relatively low thermal expansion properties or the like are provided with metal coatings of a second material thereon and are disposed in a metal matrix, the metal matrix being selected for other properties such as light weight or high thermal conductivity or the like. A selected bond such as a metallurgical diffusion-bond is formed between the coatings on the portions of the first material and the metal matrix material for securing the portions of the first material at selected locations in the metal matrix. In one preferred embodiment of the invention, the first material comprises a multiplicity of discrete elements of a metal material having the coatings thereon metallurgically bonded to the first metal material. In another preferred embodiment, the first material comprises a metal wire having metal coatings thereon metallurgically bonded to the wire, the coated wire being provided in the form of a metal mesh disposed in a metal matrix material and having coated portions of the wire mesh metallurgically bonded to the matrix material. In another preferred embodiment, the first material comprises a ceramic material and the metal coatings thereon hold the ceramic material under compression within the coatings. The coated ceramic elements are dispersed within a metal matrix which is diffusion-bonded to the metal coatings of the ceramic elements. In preferred embodiments of the methods of this invention, the portions of the first material having the metal coatings thereon are covered with a powdered metal matrix material and the combined materials are subjected to a heat-treatment such as a sintering for diffusion-bonding particles of the powder metal matrix materials to each other and to the materials of the coatings for forming the composite material and for securing the portions of the first material in selected locations in the composite material. In one preferred embodiment of the invention, the coating and matrix materials embody the same metals and the coatings and metal matrix materials are diffusion-bonded together. In another preferred embodiment, the coating and matrix materials embody different metals and the coating and metal matrix materials are heat-treated for forming intermetallic compounds of said metals for securing the portions of the first materials in selected locations in the composite materials. The energy needed to produce the reaction forming the compound may be injected in the form of ultrasonic vibration, inductive heating, explosive shock, magnetic excitation or the like.

DESCRIPTION OF THE DRAWINGS

Other objects, advantages and details of the novel and improved composite materials and methods of this invention appear in the following detailed description of preferred embodiments of the invention, the detailed description referring to the drawings in which.

DESCRIPTION OF THE PREFERRED EMBODIMENTS

Figure 1:
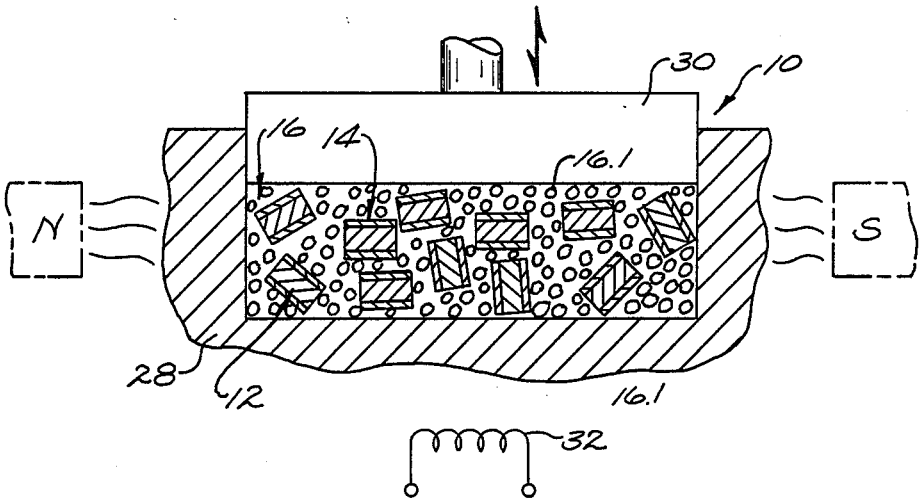
FIG. 1 is a diagrammatically view illustrating steps in a preferred embodiment of the method of the invention for forming a preferred embodiment of the composite material of the invention.

Referring to the drawings, 10 in FIG. 1 diagrammatically illustrates a preferred embodiment of the composite material of this invention which is shown to comprise a plurality of portions 12 of a first material having metal coatings 14 of a second material thereon disposed in a metal matrix 16 and having selected bonds 18 between the materials of the coatings and the matrix securing the portions 12 of the first material at selected locations in the matrix 16.

Figure 4:
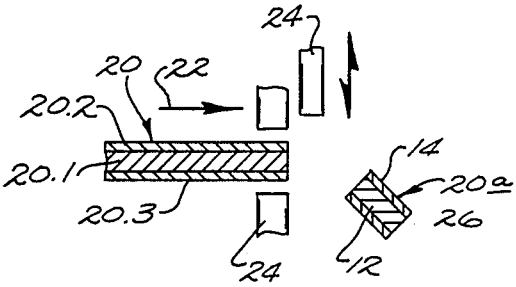
FIG. 4 is a diagrammatic view illustrating a step in a preferred embodiment of the method of this invention.

In a preferred embodiment of the method of the invention, the portions 12 of the first material having the coatings 14 thereon are made from a metal-clad metal wire 20 as shown in FIG. 4. That is, a clad metal wire 20 of generally round cross section for example and embodying a core part 20.1 of a first metal material having a metal coating or cladding 20.2 bonded to the core along an interface 20.3 is advanced as indicated by the arrow 22 in FIG. 4 into a conventional cut-off tool or the like as diagrammatically illustrated at 24 for cutting off selected lengths or fibers **20*a* of the clad metal wire. In that arrangement, each cut-off length or fiber 20*a* of the clad metal wire embodies a portion 12 of the desired first material having a coating 14 of a desired second metal material thereon. Preferably the coating 14 is secured to the portion 12 of the first material by a metallurgical bond at the interface 26 therebetween. That is, the bond between the metal portion 12 and its metal coating 14 is preferably an interatomic bond between materials of the noted core and cladding so that the core and cladding are securely attached to each other. Preferably that bond is one which is formed in the solid phase. As the manufacture of such metal-clad metal wires with solid phase metallurgical bonds is conventional as shown in U.S. Pat. No. 3,220,107 for example, the formation of the fibers 20*a* is not further described herein and will be understood that various combinations of core and cladding materials are embodied in the portions 12 and coatings 14 within the scope of this invention. Of course other conventional procedures for making metal-clad metal wires are also used within the scope of this invention. Preferably the metal wire 20 has a fine wire diameter in the range up to about 0.010 inches and the fibers 20*a*** are preferably cut-off with a length in the range equal to about 10 to 20 diameters of the wire.

In accordance with the preferred method of the invention, a plurality and preferably a multiplicity of the discrete portions 12 of the first material having the metal coatings 14 thereon are mixed together with particles 16.1 of a powder metal matrix material as shown in FIG. 1 so that the discrete portions 12 of the first material are dispersed substantially uniformly throughout the mixture. The portions 12 of the first material with the metal coatings 14 thereon are shown in section in FIG. 1 and are shown in relatively limited number for clarity of illustration but it will be understood that very small fibers **20*a* are preferably used and that they are preferably mixed with metal powders having particles 16.1 in the size range from about 40 to 250 mesh or the like within the scope of this invention, the size, material and relative volume of the fibers and metal powders being selected for providing the resulting composite material 10 with desired properties as discussed below. Typically, the volume of the composite material 10 made up by the discrete portions 12** of the first material will vary from 10 to 90 percent of the total volume of the composite depending on the intended purpose of the composite and the like. If desired, an organic binder material or the like (not shown) is combined with the mixture of fibers and metal powder to facilitate blending of the materials in conventional manner. Besides conventional blending, external means for orientation of the filler can be used such as magnetic fields or vibration.

Figure 2:
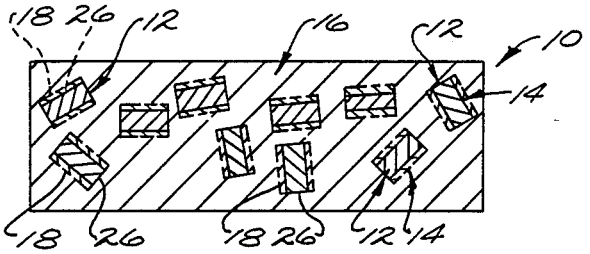
FIG. 2 is a diagrammatic view similar to FIG. 1 illustrating steps in forming a composite material of this invention.
Figure 3:
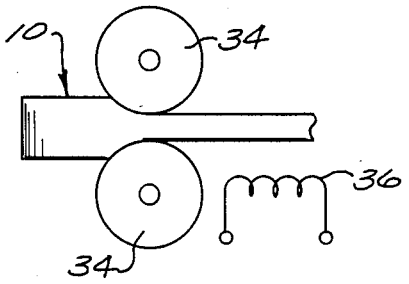
FIG. 3 is a diagrammatic view illustrating a step in a preferred embodiment of the method of this invention.

In accordance with this method invention, the desired mixture of fibers and metal powders is preferably placed in a container as diagrammatically illustrated at 28 in FIG. 1 and is compacted as diagrammatically indicated by the pressing means 30 for reducing porosity of the mixture to a desired extent. The described mixture is then subjected to a heat-treatment as diagrammatically indicated by the heater 32 for driving off any organic binder materials which may have been used and for diffusion-bonding or sintering the particles 16.1 of the powder metal matrix material to each other and to the metal coatings 14 for forming the composite material and for securing the discrete portions or elements 12 of the first material at selected locations in the metal matrix 16 as shown in FIG. 2. If desired, the mixture of fibers and metal powder is compacted and diffusion-bonded in any of various ways as are conventionally used in powder metal technology within the scope of this invention. That is, if desired the mixture is compacted in various ways as are conventional in powder metallurgy either by pressing or roll bonding and is heat-treated in any of the various ways employed in powder metallurgy either by batch processes or in continuous processes with or without a protective atmosphere as may be indicated by the nature of the materials embodied in the mixture and by the temperatures employed in heat-treating the mixture. For example in one procedure the mixture of fibers and metal powders are compacted for providing initial green or incipient metallurgical bonds between the mixture materials with or without partial heat-treatment for enhancing or strengthening such incipient bonds. The resulting composite material is then subjected to rolling reduction of thickness or other shaping in any conventional manner as is diagrammatically indicated at 34 in FIG. 3 and is then subjected to additional heat-treatment if desired as diagrammatically indicated at 36 in FIG. 3 for further sintering or diffusion-bonding the components of the composite material 10. In that way, depending on the nature of the materials embodied in the composite material 10, the heat-treatment is carried out immediately after initial mixing and/or compaction or is deferred until after formation of the composite material by a final desired rolling or shaping or the like as is preferred. In that way the composite material with the dispersed components therein is easily formed into a desired shape and the diffusion-bonding thereafter serves to securely position the dispersed components in desired positions in the composite material.

In one preferred embodiment of the invention as above-described, the metal wire 20 comprises a core 20.1 of a conventional nickel-iron alloy characterized by a relatively low coefficient of thermal expansion such as one of those alloys selected from the group consisting of alloys having a nominal composition by weight of from about 36 to 42 percent nickel and the balance iron or nickel-iron binaries with addition of cobalt. The cladding 20.2 provided on the wire core preferably comprises copper, aluminum or other metal material of relatively high thermal conductivity, preferably having a solid phase metallurgical bond to the core material. Fibers **20*a* prepared as above described are combined with copper metal powder having particle sizes 16.1 in the ranges previously noted and are compacted and subjected to heat-treatment as above described for diffusion-bonding or sintering the metal powder particles to each other and to the copper coatings 14 of the fibers for forming the composite material 10 having the discrete portions 12 of the first material of relatively low coefficient of thermal expansion securely positioned in selected dispersed relation in the copper matrix 16 of the composite material which displays relatively high thermal conductivity. Preferably for example, where a conventional organic binder is used in mixing the noted materials, the mixture is heated to a temperature in the range from about 100° to 250° C. for driving off the organic binder materials from the mixture and is then heated to a sintering or diffusion-bonding temperature in the range from about 600° to 850° C. to sinter and diffusion-bond the materials for a period from about 2 minutes to about 10 hours to produce a substantially solid composite metal material 10. Preferably the materials are sintered in an inert atmosphere or the like. In that way, the bond 18 formed between the copper coating 14 and the powder materials 16 comprises a strong metallurgical bond as indicated by the dotted lines 18 shown in FIG. 2 for securely positioning the portions 12 of the low expansion material in the copper matrix. Preferably the size and the volume of the fibers 20*a* and their core and cladding diameters and lengths are selected so that the portions 12 of the first material of relatively low thermal expansion coefficient comprise 70 or more percent of the total volume of the composite material 10. In that arrangement, the composite material 10 is adapted to display a relatively very low coefficient of thermal expansion (TCE) between that of the first material 12 and that of the copper materials of the coatings 14 and metal powders 16.1 and substantially corresponds to that TCE which would be indicated by the ratio of the volumes of such materials incorporated in the composite material. However, the composite material is also adapted to display relatively high thermal conductivity along the x, y and z axes of the composite materials as will be understood. In that way, the composite material 10 as above described comprises a novel and improved material particularly suited for mounting semiconductor devices such as integrated circuit chips and the like to provide thermal coefficient of expansion matching to the semiconductor chip material while also serving to dissipate heat from the chip in an efficient manner. It should be understood that although the composite material 10 is shown to be made using fibers 20*a* having core and cladding joined with solid phase metallurgical bonds, the coatings 14 are also provided on the portions 12** of the first material by hot dipping, electrolytic plating, electroforming, vapor deposition or in any other conventional coating procedure within the scope of this invention. It will also be understood that various different materials are embodied in the first, second, and matrix materials in the composite material of the invention.

In another preferred embodiment of the invention, the metal wire 20 comprises a core 20.1 of a material selected for displaying relatively high strength. Preferably for example, the core material comprises titanium or a titanium alloy material and the cladding 20.2 provided on the core comprises aluminum metal applied by dipping or the like or in any other conventional manner. Fibers **20*a* cut from that aluminum-clad titanium or titanium alloy wire are of a size as previously described and are combined with metal powders such as alpha titanium aluminide or gamma titanium aluminide powders or the like having particle sizes as previously described, with or without organic binder materials, and are compacted or rolled or the like or otherwise formed into desired shapes. The compacted mixture is then subjected to heat-treatment or other means of energy insertion like ultrasonic vibration, inductive heating or magnetic energy as above described for sintering and diffusion-bonding the particles of the titanium aluminide metal powders to each other and to the aluminum coatings 14 provided on the portions 12 of titanium or titanium alloy materials, thereby to form a high strength, low weight composite material 10 as will be understood. Preferably for example, the materials are heated at a temperature in the range from about 100° to 250° C. for driving off any organic binder materials and are then sintered at a temperature in the range from about 200° to 550° C. for a period from about two minutes up to about 10 hours for providing a substantially solid composite material which is substantially free of pores. Preferably the sintering is conducted at a temperature at which the first materials in the discrete portions 12 and the matrix materials 16 each react with the materials of the aluminum coatings 14 for forming intermetallic titanium aluminide compounds at the bond locations 18 and 26 for securely positioning the discrete strengthening portions 12 of the composite at selected dispersed locations in the matrix 16 of the composite material. In that way, the composite material is easily formed and shaped until the discrete strengthening portions of titanium or titanium alloy metal are securely positioned in the matrix by the heat-treatment thereof. In that way, the composite material is provided with desired high strength-low weight characteristic in a novel, economical and advantageous way. It should be understood that other metal materials or the like are also embodied in the composite material 12 within the scope of this invention. For example, the discrete portions 12 are also formed of molybdenum, tungsten, steel, stainless steel or other nickel or iron-based alloy materials or the like such as those described above within the scope of this invention. The powder metal matrix material 16** are also selected from aluminum metal, copper or other metal materials within the scope of this invention. Other metal coating materials are also used.

Figure 5:
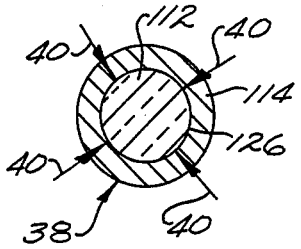
FIG. 5 is a section view to enlarged scale through a component of a preferred embodiment of a composite material of this invention.
Figure 6:
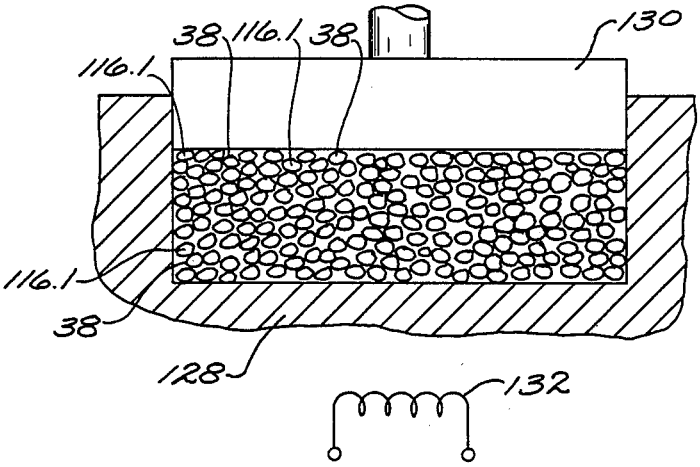
FIG. 6 is a diagrammatic view similar to FIG. 1 illustrating steps in an alternate preferred embodiment of the method of this invention for making an alternate preferred embodiment of the composite material of the invention utilizing the components of FIG. 5.
Figure 7:
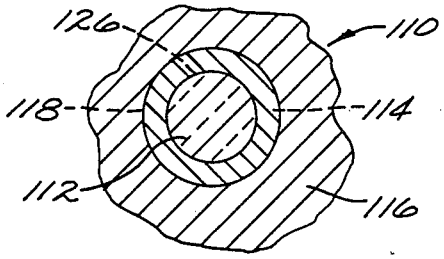
FIG. 7 is a partial section view to enlarged scale of the composite material made according to FIG. 6.

In another preferred embodiment of this invention as illustrated in FIGS. 5–7, wherein comparable components are identified by a comparable reference numerals, the discrete portions 112 of a first material dispersed in a matrix 116 are formed of a ceramic material such as silicon carbide, boron nitride, alumina, yttria or the like and are provided with coatings 114 of aluminum or copper metal or the like for forming interfaces 126 in the elements 38 as shown in FIG. 5. Preferably the coatings are applied by a hot-dip process, high energy iron plating or the like and the coating materials have a relatively higher coefficient of thermal expansion than the noted ceramic materials so that, upon cooling, the coatings place the ceramic materials 112 under compression as indicated by the arrows 40 in FIG. 5. In that way, ceramic materials are provided with high strength. Preferably the metal-coated ceramic elements 38 are spherical as shown but the elements also are adapted to be elongated or fiber-like within the scope of this invention. The elements 38 are then mixed with or dispersed in a powder metal material having particles 116.1 of a metal matrix material such as aluminum or the like. The mixture is compacted and subjected to heat-treatment as described above and as is indicated by the container 128, the compacter 130 and the heater 132 diagrammatically illustrated in FIG. 6, thereby to sinter or diffusion-bond the materials of the powder particles 116.1 to each other and to the coatings 114 for forming the composite material 110 shown in the partial section view of FIG. 7 wherein the ceramic portions 112 are secured in dispersed relation to each other in a matrix 116 for forming the composite material 110 and for securing the ceramic portions 112 in selected location within the matrix by diffusion-bonds between the matrix and coating materials as indicated at 118 in FIG. 7. If desired, the mixture is rolled or otherwise formed into a desired shape before being subjected to the noted heat-treatment, the materials being temporarily held in the desired shape by use of an organic binder or the like or by incipient metallurgical bonds between the powder and coating materials as a result of compaction thereof. In that arrangement, the thermal coefficient of expansion properties of the ceramic portions 112 cooperate with the thermal expansion coefficient of the coating and matrix materials for determining the coefficient of thermal expansion of the composite material 110, the TCE of the composite generally corresponding to that which would be indicated by the ratio of volumes of the ceramic and metal materials as previously noted. The ceramic portions 112 are uniformly distributed throughout the composite material permitting the composite to display a relatively high thermal conductivity along the x, y and z axes through the composite as will be understood. As will also be understood, particularly where the discrete portions 112 are formed of silicon carbide or the like, the ceramic portions 112 are also adapted to provide the composite with improved strength or the like.

Figure 8:
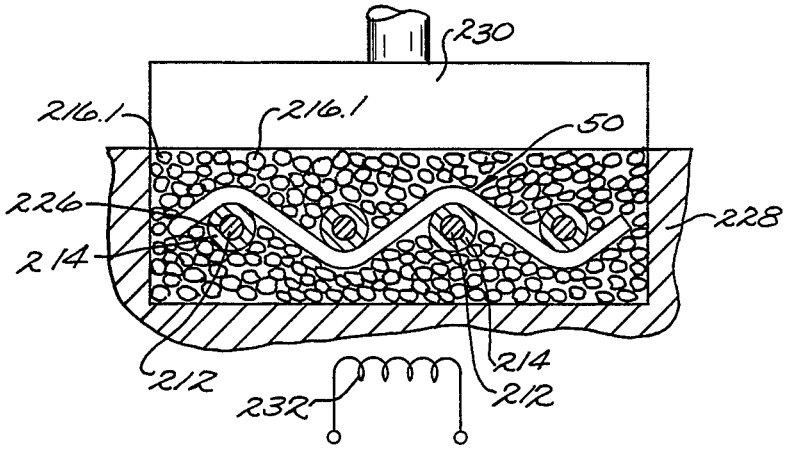
FIG. 8 is a diagrammatic view similar to FIG. 1 illustrating steps in an alternate preferred method of this invention for forming an alternate preferred embodiment of the composite material of the invention.
Figure 9:
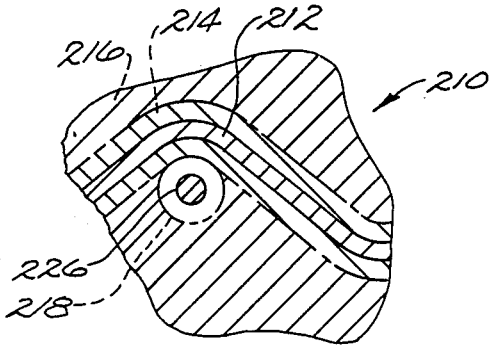
FIG. 9 is a partial section view to enlarged scale of the composite material made according to FIG. 8.

In another preferred embodiment of the invention as illustrated in FIGS. 8 and 9, the first material 212 is provided in wire form having a metal cladding 214 thereon and the wire is woven into the form of a selected wire mesh 50 as shown in FIG. 8 for dispersing portions of the first material 212 throughout a metal matrix formed by a powder material 216.1 as indicated in FIG. 8. As will be understood, the mesh and that powder material are then compacted and subjected to heat-treatment as previously described and as is indicated by the container 228, compacter 230 and heater 232 diagrammatically illustrated in FIG. 8, thereby to diffusion-bond the powder materials to each other and to the coating material on the wire mesh for forming the composite material 210 as shown in the partial section view of FIG. 9. In that arrangement, the first material embodied in the wire 212, the second material embodied in the coating 214, and the matrix materials 216 are selected from the materials provided for corresponding components in the composite materials previously described or from other materials as may be desired for providing the composite material 210 with desired strength or thermal conductivity and thermal expansion properties or the like. If desired, the diffusion-bonds 218 are formed between like materials in the coating and matrix materials or provide intermetallic compounds or the like when formed between different coating and matrix materials. It should be noted that where the wire mesh 50 is utilized as above described, the powder metal materials 216 are also adapted to be provided in a suitable slurry with an aqueous or organic carrier medium of any conventional type and to be applied to the wire mesh by a doctor blade or the like as diagrammatically illustrated at 54 in FIG. 8. In addition, if desired, the wire mesh is adapted to be passed through a conventional plating bath or the like (not shown) for depositing a layer of metal corresponding to the coating 214 or matrix material 216 or the like on the mesh before diffusion-bonding of the matrix material 216 or in place of such diffusion-bonded matrix material. Alternately, although the wire mesh 50 is shown to comprise coated wire, the wire is also adapted to be formed of an uncoated wire embodying a material such as a material of low coefficient of thermal expansion as one of the nickel and iron alloys described above and to be disposed within a copper matrix material or the like to be diffusion-bonded directly to the copper material in the manner corresponding to the manner above-described, thereby to provide a composite material having the low coefficient thermal expansion mesh distributed throughout the copper matrix and/or coating material of the mesh and secured in selected locations in the matrix by the diffusion-bonding to the matrix materials. Alternately of course, the uncoated wire mesh could be formed of titanium or titanium alloy materials or the like and can be disposed within a matrix material of titanium aluminide or of aluminum and its alloys as above described.

It should be noted that although preferred embodiments of the invention have been described by way of illustrating the invention, the invention includes all modifications and equivalents of the disclosed embodiments falling within the scope of the appended claims.

I claim:

1. A composite metal material having discrete elements of a first metal material having respective coatings of a second material disposed thereon, the coated elements being dispersed in a metal matrix material and having a metallurgical bond between the coatings of the second metal material and the metal matrix material securing the coated elements at selected locations in the matrix material, the metallurgical bond between the coatings of the second metal material and the metal matrix material comprising a diffusion-bond forming an intermetallic compound.

2. A composite metal material according to claim 1 wherein the first metal material embodied in the discrete elements is selected from the group of metal materials consisting of titanium and titanium alloys, and nickel-iron alloys, the coating material comprises aluminum, and the intermetallic compound comprises an aluminide.

3. A composite metal material according to claim 2 wherein the second metal material is placed on discrete elements of the first metal material.

4. A composite metal material comprising a wire of a first metal material having a coating thereon of a second metal material in the form of a wire mesh disposed in a metal matrix material and having a selected bond between the coating of the second metal material on various portions of the metal mesh and the metal matrix material securing said coated metal portions of the mesh at selected locations in the matrix material, the metallurgical bond between the second coating material and the matrix material comprising a diffusion-bond forming an intermetallic compound.

5. A composite metal material according to claim 4 wherein the first metal material embodied in the wire is selected from the group of metal materials of relatively high strength consisting of titanium and titanium alloys, steels, stainless steels, and other nickel-iron alloys, the coating material comprises aluminum, and the intermetallic compound comprises an aluminide.

6. A composite material having discrete elements of a ceramic material having respective coatings of a metal material thereon dispersed in a metal matrix material and having a selected bond between the metal of the metal coating material and the matrix material securing the coated elements at selected locations in the matrix material, the ceramic material of the discrete elements being selected from the group consisting of silicon carbide, boron nitride, yttria and alumina, the coating material on the discrete elements comprising aluminum, and the matrix material being selected from the group consisting of alpha titanium aluminide and gamma titanium aluminide, the coating of the discrete elements being diffusion bonded to the matrix material by an intermetallic compound formed between the coating and matrix materials.

7. A method for making a composite metal material comprising the steps of providing a multiplicity of discrete elements of a first material having metal coatings of a second metal material thereon, dispersing the coated elements in a powder metal matrix material, and forming a selected bond between particles of the powder metal matrix material and between said particles and the second metal material for securing the discrete elements at selected locations within the matrix material, the discrete elements comprising fibers embodying lengths of wire of a first metal material having claddings of the second metal material metallurgically bonded thereto, the first metal material being selected from the group of metals of relatively high strength consisting of titanium and titanium alloys, steels, stainless steels, and other nickel-iron alloys, the coating material comprising aluminum, and the matrix material comprising powder metal materials selected from the group consisting of alpha titanium aluminide and gamma titanium aluminide, the powder metal materials being mixed with the discrete elements and heat-treated for diffusion-bonding particles of the power metal to each other and to the material of the coatings to form the composite material and for forming aluminide intermetallic compounds between the discrete element and coating materials for securing the discrete elements at selected locations in the composite material.

8. A method for making a composite material comprising the steps of providing a multiplicity of discrete elements of a ceramic material having respective coatings of a metal material thereon, dispersing the coated ceramic elements in a powder metal matrix material, and forming a selected bond between particles of the powder metal material and between said particles and the metal coating material of the discrete ceramic elements for forming the composite material and securing the discrete elements at selected locations therein, the material of said coatings being applied to the discrete ceramic elements at elevated temperature and subsequently cooled for holding the ceramic materials under compression within the coatings, the ceramic material being selected from the group consisting of silicon carbide, boron nitride, yttria and alumina, the coating material comprising aluminum, and the powder metal matrix material being selected from the group consisting of alpha titanium aluminide and gamma titanium aluminide.

* * * * *